US009022785B2

(12) United States Patent
Dribben

(10) Patent No.: US 9,022,785 B2
(45) Date of Patent: May 5, 2015

(54) MONITORING SHOTS OF FIREARMS

(76) Inventor: Ehud Dribben, ShaArei Tikva (IL)

( * ) Notice: Subject to any disclaimer, the term of this patent is extended or adjusted under 35 U.S.C. 154(b) by 0 days.

(21) Appl. No.: 13/498,326

(22) PCT Filed: Jan. 25, 2011

(86) PCT No.: PCT/US2011/022327

§ 371 (c)(1),
(2), (4) Date: Mar. 26, 2012

(87) PCT Pub. No.: WO2011/094177

PCT Pub. Date: Aug. 4, 2011

(65) Prior Publication Data

US 2012/0183930 A1 Jul. 19, 2012

(30) Foreign Application Priority Data

Jan. 26, 2010 (IL) ..... 203526

(51) Int. Cl.

| | |
|---|---|
| ***F41G 3/26*** | (2006.01) |
| ***G04F 10/00*** | (2006.01) |
| ***F41J 5/00*** | (2006.01) |
| ***F41J 11/00*** | (2009.01) |

(52) U.S. Cl.

CPC *G04F 10/00* (2013.01); *F41G 3/26* (2013.01); *F41J 5/00* (2013.01); *F41J 11/00* (2013.01)

(58) Field of Classification Search

USPC ..... 434/16–24

See application file for complete search history.

(56) References Cited

U.S. PATENT DOCUMENTS

| | | | | |
|---|---|---|---|---|
| 5,316,479 | A * | 5/1994 | Wong et al. | 434/11 |
| 5,577,733 | A * | 11/1996 | Downing | 273/348 |
| 5,785,592 | A | 7/1998 | Jacobsen | |
| 5,980,254 | A | 11/1999 | Muehle et al. | |
| 2003/0134700 | A1 | 7/2003 | Salva | |
| 2005/0153262 | A1 | 7/2005 | Kendir | |
| 2008/0163536 | A1 | 7/2008 | Koch et al. | |
| 2008/0304361 | A1 * | 12/2008 | Peng et al. | 367/127 |

OTHER PUBLICATIONS

International Search Report and Written Opinion issued for PCT/US2011/022327 on Oct. 25, 2011.

* cited by examiner

*Primary Examiner* — Sam Yao
*Assistant Examiner* — Evan Page
(74) *Attorney, Agent, or Firm* — Pearl Cohen Zedek Latzer Baratz LLP

(57) ABSTRACT

A shooting range management system that includes at least one shot detection transducer configured to detect the exit of a shot fired from a ballistic weapon and at least one impact detector configured to detect the impact of the shot on a target. The system further comprises a receiver connected to the at least one shot detection transducer and the at least one impact detector, the receiver including a timer configured to time the firing of at least one shot and to time the impact of the at least one shot and produce a data record thereof, and a display connected to the receiver, the display configured to display the data record of the receiver.

8 Claims, 5 Drawing Sheets

MONITORING SHOTS OF FIREARMS

BACKGROUND

1. Technical Field

The present invention relates to the field of firearms accessories and more particularly, to firearms accessories for firing management and training in live fire.

2. Discussion of Related Art

Firearms are utilized for a variety of purposes, such as hunting, sports competition, and law enforcement. To teach accuracy and correct technique in shooting a firearm, target practice areas are utilized wherein multiple shooters shoot live ammunition at multiple targets under the supervision of an instructor.

To keep track of the accuracy or shooting technique of one or more shooters, it is often necessary for an instructor or a shooter to be able to review observe specific shooting skills in real time.

BRIEF SUMMARY

Embodiments of the present invention provide a shooting range management system. One system comprises at least one shot detection transducer configured to detect the exit of a shot fired from a ballistic weapon and at least one impact detection transducer configured to detect the impact of the shot on a target. Accordingly, according to an aspect of the invention, the system further comprises a receiver connected to the at least one shot detection transducer and the at least one impact detection transducer, the receiver including a timer configured to time the firing of at least one shot and to time the impact of at least one shot and produce a data record thereof, and a display connected to the receiver, the display configured to display the data record of the receiver. Moreover, hits are recorded by an imaging device and exact location on the target is being processed.

According to some embodiments of the invention, the receiver includes a memory configured to maintain a record of the data record.

According to some embodiments of the invention, the display is connected to a computer, including any hardware having a processor, storage a user interface and software running thereon.

According to some embodiments of the invention, the computer includes a memory configured to maintain a record of the data record.

According to some embodiments of the invention, the computer includes a printer configured to print the data record of the receiver.

According to some embodiments of the invention, the connection between the at least one shot detection transducer and the receiver is either wire-line or wireless According to some embodiments of the invention, the connection between the at least one impact detection transducer and the receiver is either wire-line or wireless According to some embodiments of the invention, the at least one shot detection transducer includes a transceiver and the receiver includes a transceiver and the connection therebetween is wireless, being from transceiver to transceiver.

According to some embodiments of the invention, the at least one blast detection transducer includes a transceiver and the receiver includes a transceiver and the connection therebetween is wireless, being from transceiver to transceiver.

According to some embodiments of the invention, the invention may include a noise filter configured to filter unwanted noise, said noise filter being operatively associated with at least one of: the shot detection transducer, the impact detection transducer, and the receiver. The noise filtered may be needed when the shot is detected by an acoustic sensor and filtering is required to avoid false alarms and/or no detection of a shot.

According to some embodiments of the invention, the invention includes an external power source wired to at least one of: the shot detection transducer, the impact detection transducer, and the receiver.

According to some embodiments of the invention, the invention includes an internal power source internal to at least one of: the shot detection transducer, the impact detection transducer, and the receiver.

According to some embodiments of the invention, the shot detection transducer includes at least one sensor comprising at least one of: a vibration sensor, a shock sensor, a motion sensor, a sound sensor, a pressure sensor, and a trigger movement sensor.

According to some embodiments of the invention, the at least one shot detection transducer additionally includes at least one analogue to digital convertor circuit.

According to some embodiments of the invention, the at least one hit (the bullet hitting the target) detection transducer includes at least one sensor comprising at least one of: a vibration sensor, a shock sensor, a motion sensor, a sound sensor, a pressure sensor, and an imaging device.

According to some embodiments of the invention, the at least one blast detection transducer additionally includes at least one analogue to digital convertor circuit.

These, additional, and/or other aspects and/or advantages of the present invention are set forth in the detailed description which follows; possibly inferable from the detailed description; and/or learnable by practice of the present invention.

BRIEF DESCRIPTION OF THE DRAWINGS

The present invention will be more readily understood from the detailed description of embodiments thereof made in conjunction with the accompanying drawings of which.

DETAILED DESCRIPTION

Figure 1:
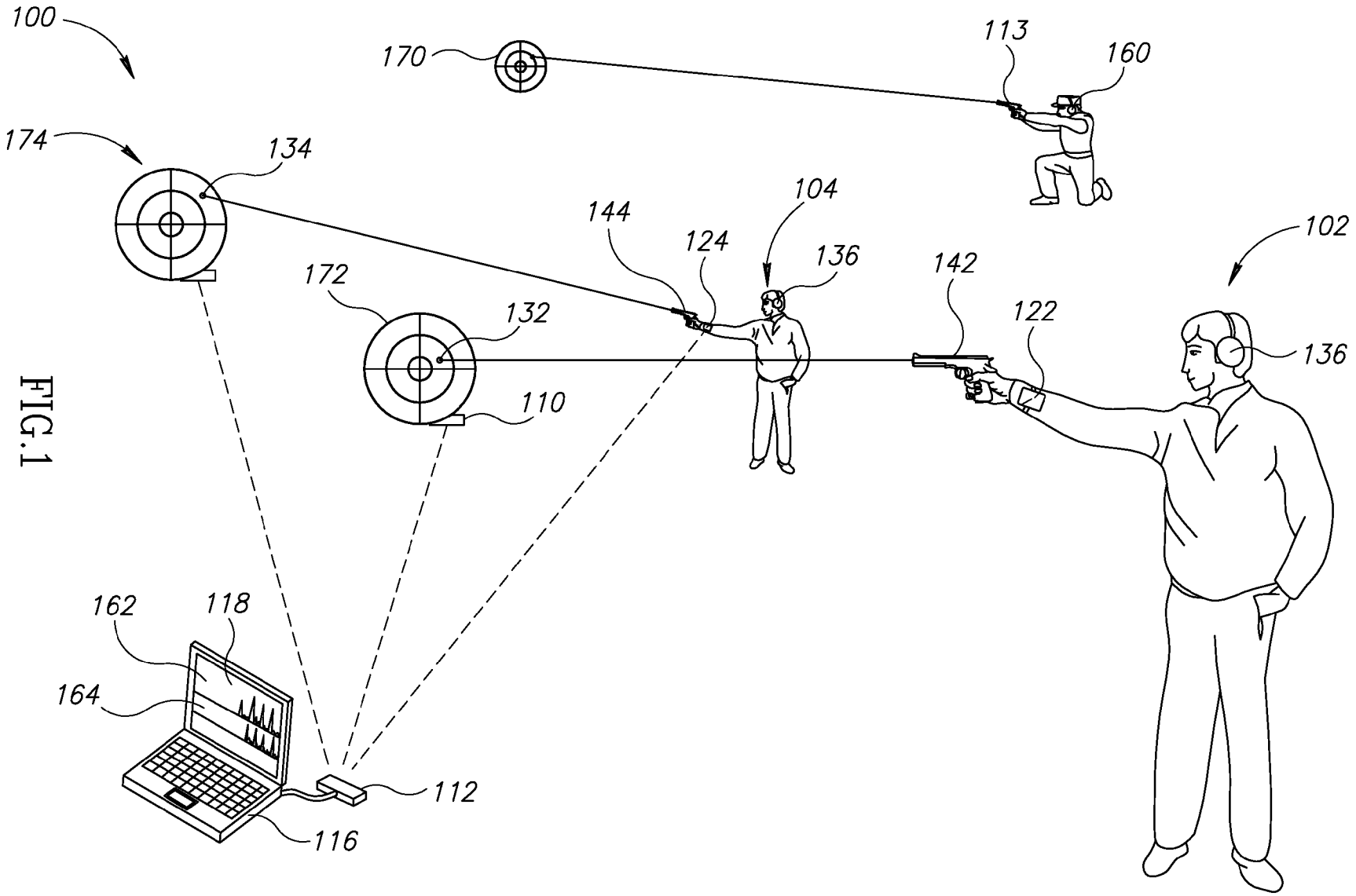
FIG. 1 shows a shooting range management system, according to some embodiments of the invention.

Prior to setting forth the detailed description, it may be helpful to set forth definitions of certain terms that will be used hereinafter As used herein, the term "shooting range" encompasses firing ranges, target ranges, shooting training, smart shooting range or other weapons training or testing environments or configurations.

As used herein, the phrases "multiple user shooting ranges", "multiple user shooting areas", or similar phrases refer to areas in which there are multiple shooters users shooting in areas in which there is firing range management.

As used herein, the phrase "firing range management"; refers to, inter alia, group shooting; multi-user shooting; time-challenged shooting; smart shooting ranges; timed shooting management, and other group oriented shooting or training implementations.

As used herein, the terms "ballistic weapon" or "weapon" refers to any armament that shoots projectiles after power has been cut off and includes, inter alia, any ballistic weapon that is held by one or two hands, or shoulder or torso mounted, or held away from the body.

As used herein, wireless data input technologies to communicate signals or data, comprise communication technologies using LAN, WLAN, Bluetooth, Zigbee, Ethernet, USB, cables, and any other wireless technology presently existing or developed in the future.

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

Reference is now made to FIG. 1 which illustrates a shooting range management system 100. A first shooter 102, wearing a shot recorder 122, is aiming a weapon 142 at a target 172. A second shooter 104, wearing a shot recorder 124 is aiming a weapon 144 at a target 174.

Shot recorders 122 and 124 are typically worn on the wrist or arm of shooters 102 and 104 respectively and record: (can also be inside the weapon and not only by wrist movement) (i) wrist movement; (ii) cocking of the trigger, rotating the barrel, or pulling the slide bar of weapon 142 or 144; or (iii) the exit blast as bullets 132 and 134 leave weapons 142 and 144 respectively.

Shot recorders 122 and 124 contain one or more sensors, such as vibration sensors, shock sensor, motion sensor, sound sensors, pressure sensors and trigger movement sensors, or other suitable sensor for identifying movement and blasts associated with weapons 142 and 144.

Shot recorders 122 and 124 transmit data with respect to movement and exit blasts associated with weapons 142 and 144 to a time integrator 112.

Impact recorders 110 record the impact of shots 132 and 134 that hit target 172 and 174 respectively, and transmits the recorded data to time integrator 112. Impact recorders 110 include any type of sensor, including inter alia, vibration sensors, shock sensors, motion sensors, sound sensors, an imaging device and pressure sensors; or any other suitable sensor for identifying and/or measuring a shot hitting a target.

Data is transmitted wirelessly as shown, or through wires that connect shot recorders 122 and 124 and impact recorders 110 with time integrator 112. In some embodiments of the invention, time integrator 112, shot recorders 122 and 124 and/or impact recorders 110, include a USB connector and are directly wired to computer 116. (112 can also be inside the computer and not only wire connected)

Time integrator 112 then integrates the data from shot recorders 122 and 124, and impact recorders 110, and produces time-based information on shots 132 and 134 that is displayed on a display 118 of computer 116.

A third shooter 160 without shot recorder 122 on his wrist has begun shooting at a target 170 and, could possibly skew the data from shot recorders 122 and 124, impact recorders 110, and/or time integrator 112. As explained below, shooting range management system 100 optionally includes a filter system to filter out unwanted noise. (again noise filter)

As shown, shooting range management system 100 optionally includes earphones 136 (it can also be a outside beep and not in earphones) so that each shooter 102 and 104 hears instructions, such as "begin shooting" and "cease fire" from an instructor (not shown).

Figure 2:
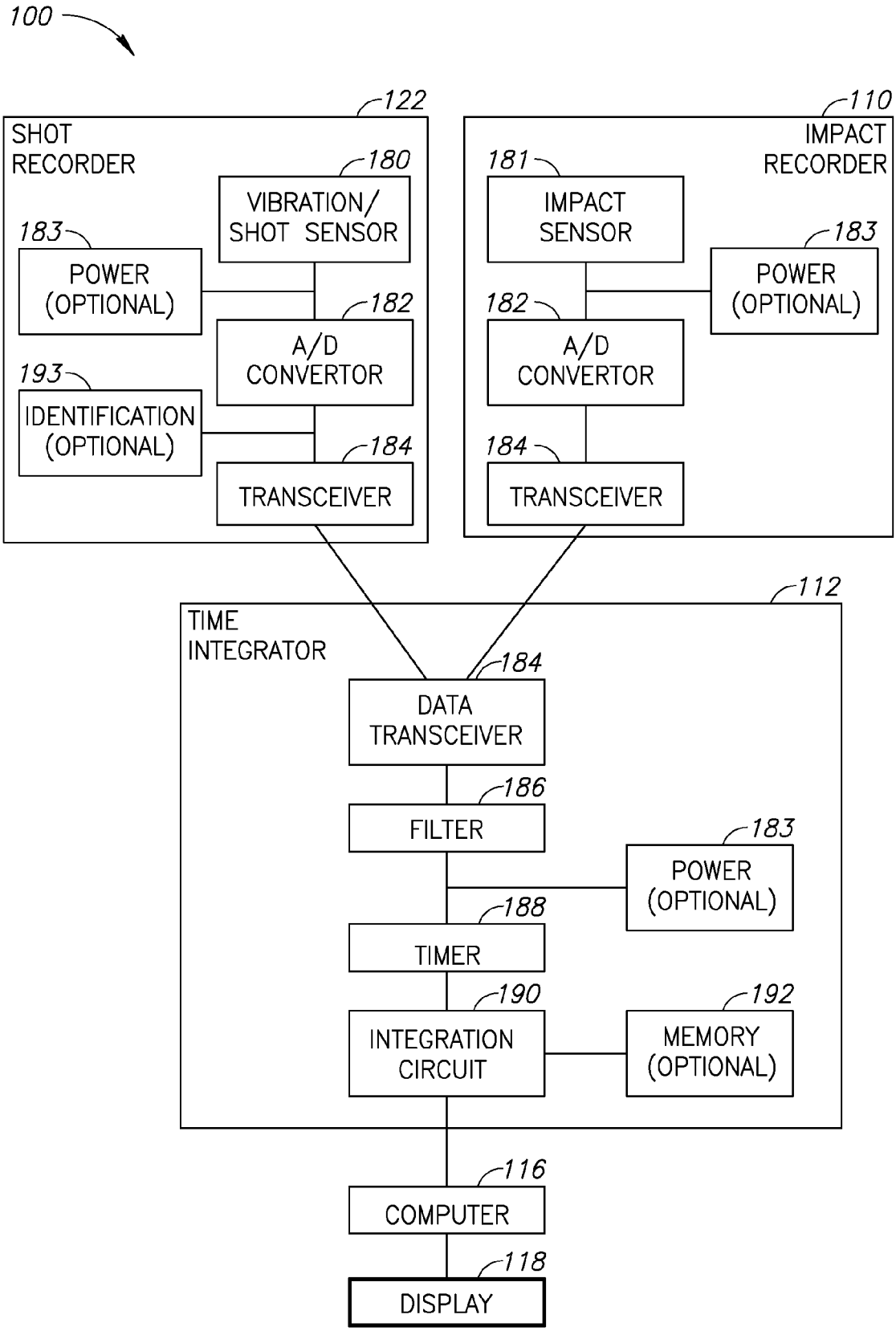
FIG. 2 is a schematic illustration the components of some of the shooting range management system shown in FIG. 1, according to some embodiments of the invention.

FIG. 2 shows a schematic diagram of components of shooting range management system 100, in which shot recorder 122 includes a vibration sensor 180 which transfers the sensed data to an analog-to-digital (A/D) converter 182. A/D converter 182 converts the vibration signals into digitally transmittable signals. Shot recorder 122 additionally includes a transceiver 184 which then transfers the digital data to time integrator 112.

Shot recorder 122 additionally optionally includes an identification module 193 that allows attachment only to a specific weapon and/or use only by a specific shooter. Identification module 193 records, for example, the shooting history, being a temporal sequence of shots and hits of a particular weapon, and optionally provides a warning, for example when the weapon requires maintenance cleaning, or part replacement.

When used by a specific shooter, identification module 193 optionally receives data from time integrator 112 and may be taken home by the shooter registered with identification module 193, for example, to download information on a home computer and compare a current session with previous sessions. Deactivation and Activation of shot recorder 122 to function with the correct weapon is optionally provided by an RFID tag on the weapon and an RFID reader in identification module 193. The data may be transferred directly to a communication device.

Impact recorders 110 typically include an impact sensor 181 which senses the impact of a bullet against the target and transfers the analog data to A/D converter 182 which is then digitally transmitted to transceiver 184.

Transceiver 184 in addition to transmitting data to time integrator 112, may also serve as a receiver of information via time integrator 112 which is optionally initiated for example by computer 116. Such received information may be a command that is typed into computer 116 to shut down shooting range management system 100.

Time integrator 112 includes data transceiver 184 which receives data from both shot recorder 122 and impact recorders 110. Time integrator 112 may be embedded within wear-on device such as a sport watch, or alternatively in a standalone device.

In embodiments, time integrator 112 includes a filter 186 that filters out unwanted noise from shots such as a shot from shooter 160 (FIG. 1) that may, for example, be interpreted as hand movement by shooters 102 and 104.

Alternatively, filter 186 filters out the impact of the shot fired from the shooter 160 (FIG. 1) that could be confused with the impact information from the impact of shots 132 and 134.

After passing through filter 186, the data is passed to a timer module 188 which assigns time variables to each dataset passed on from shot recorder 122 and impact recorders 110.

Time integrator 112 includes a digital clock that may be set at real time, for example 3:40 PM and 20 seconds. Alternatively or additionally, time integrator 112 includes a digital clock that is set at zero at the beginning of a shooting session or shooting period, by the instructor. The digital clock included in time integrator 112 optionally provides timing increments at thousandth or ten thousandth of a second in order to provide precise records of shooters 102 and 104. Such increments of each second have application in situations wherein rapid fire, for example from multiple users armed with semi-automatic or automatic weapons, is being monitored.

The data is then passed on to an integration circuit 190 which then correlates the various blasts with their appropriate impacts and transfers the information to computer 116.

Computer 116 provides the information in the above-noted visual display 118 as well as an optional audio transmittal. Time integrator 112 optionally includes a memory 192 which allows the information collected from shot recorder 122 and impact recorders or from image 110 to be stored and possibly downloaded to another computer for future reference and or comparison to other sessions utilizing a second computer. (can also be watch, PDA, cell phone).

Shot recorder 122, impact recorders 110, and/or time integrator 112, optionally include power supplies 183. As noted above, in alternative embodiments, power may be supplied through wiring passing from computer 116 to all components and/or direct wiring of the various components to a separate electric connection. The many ways of providing power to the components shown are well known to those who are familiar with the art.

Time integrator 112, shot recorders 122 and 124 and other components of shooting range management system 100, for example the safety module explained below, optionally operate using rechargeable batteries or rechargeable power units. Alternatively, power is provided by a local generator or wiring to a power supply.

In some embodiments of the invention, time integrator 112, shot recorders 122 and 124 and other components of shooting range management system 100, are optionally contained in shock-resistant housings to prevent environmental vibrations from affecting collected data. Such environmental vibrations might include, for example, vibrations generated by overflying aircraft, or vehicles passing near shooting range management system 100.

Figure 3:
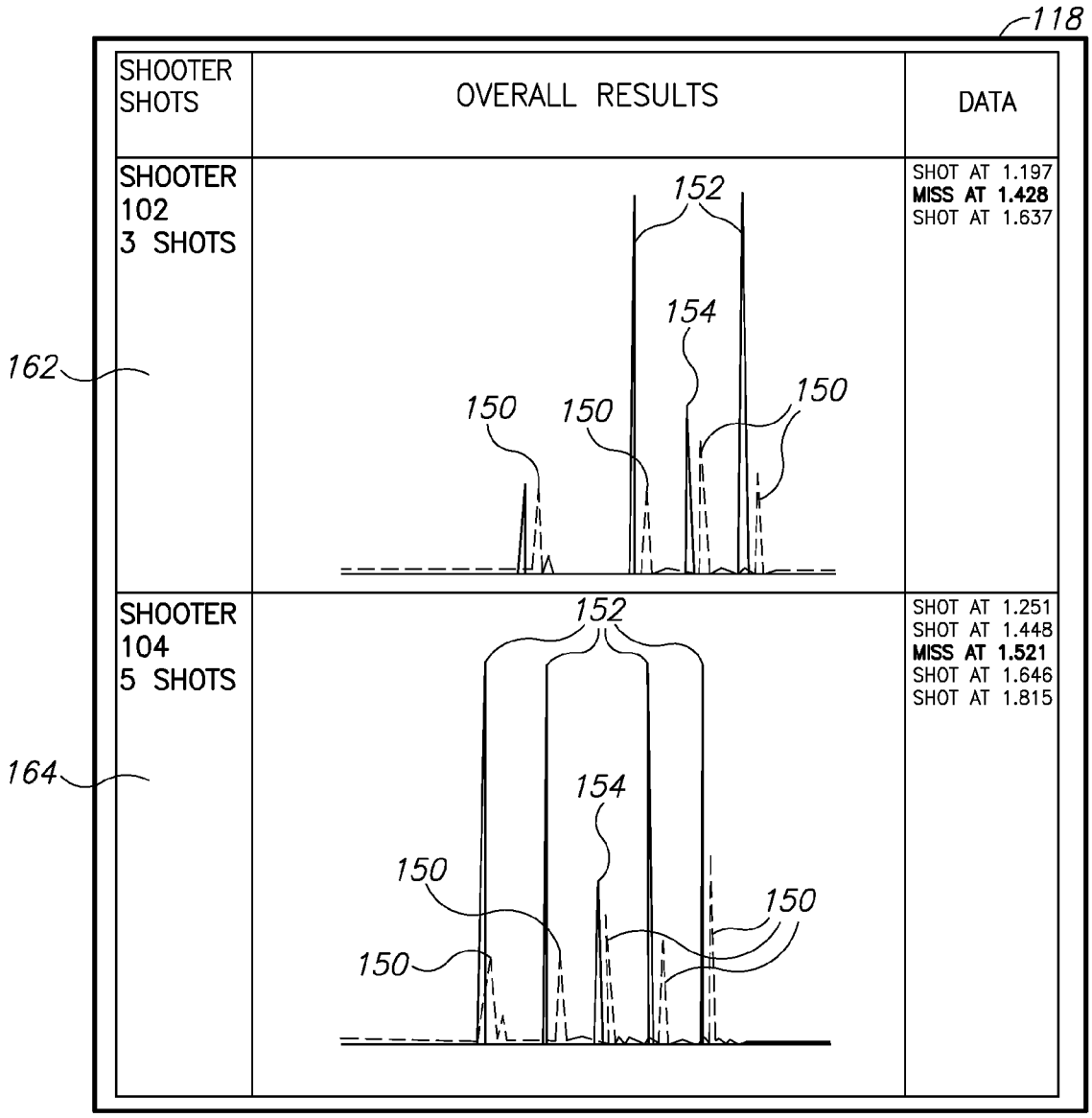
FIG. 3 shows details of a graph related to the shooting range management system shown in FIG. 1, according to some embodiments of the invention.

Shooting range management system 100 provides a wide variety of technical data that is seen in the details of display 118 displayed on computer 116 FIG. 3.

Display shows data tables 162 and 164, which illustrate, in the left column, that shooter 102 shot three shots and shooter 104 shot five shots.

The middle graph section of data tables 119 and 121 shows that shooter 102 made a hand movement 150 without firing one time, executed a hit 152 of the target two times, and registered a miss 154 of the target one time.

Additionally, shooter 104 hit 152 the target four times and missed 152 the target one time.

In addition to determining the ability of shooters 102 and 104 to hit the target, by analyzing movement 150, an instructor can optionally determine the movement of the hands and/or weapons of shooters 102 and 104, thereby providing pointers for improving the handling of the respective weapons.

For example, in misses 154 by both shooters 102 and 104, movement 150 indicates excessive time in cocking the weapons and/or excessive hand movement in aiming the weapons. Movement 150 in these cases can be indicative, for example, of hand movement which caused the weapon to lose alignment with the target.

Data column on the right shows the timing of each shot which hit the target. Alternatively, the shooting instructor can optionally switch the data column to show, inter alia, the amount of time spent on each cock and/or aiming and/or drawing 150 during a given shot, which can provide vital information in recommendations that improve the shooting technique of shooters 102 and 104.

While the utilization of shooting range management system 100 and the associated graphs 118 are illustrated with respect to two shooters 102 and 104, the present invention is contemplated for use with only one shooter 102. It is understood that embodiments of the present invention may support two or more shooters shooting a common target or alternatively—each shooter is assigned with his or her target respectively. In use with single shooter 102, as is optionally provided with multiple shooters, graphs 118 aid shooter 102 in determining a variety of technical data. Technical data provided by graph 118, includes, inter alia: intervals between each shot; hand and weapon movements prior to, during, and following shooting; and accuracy of hitting target 172.

Figure 4:
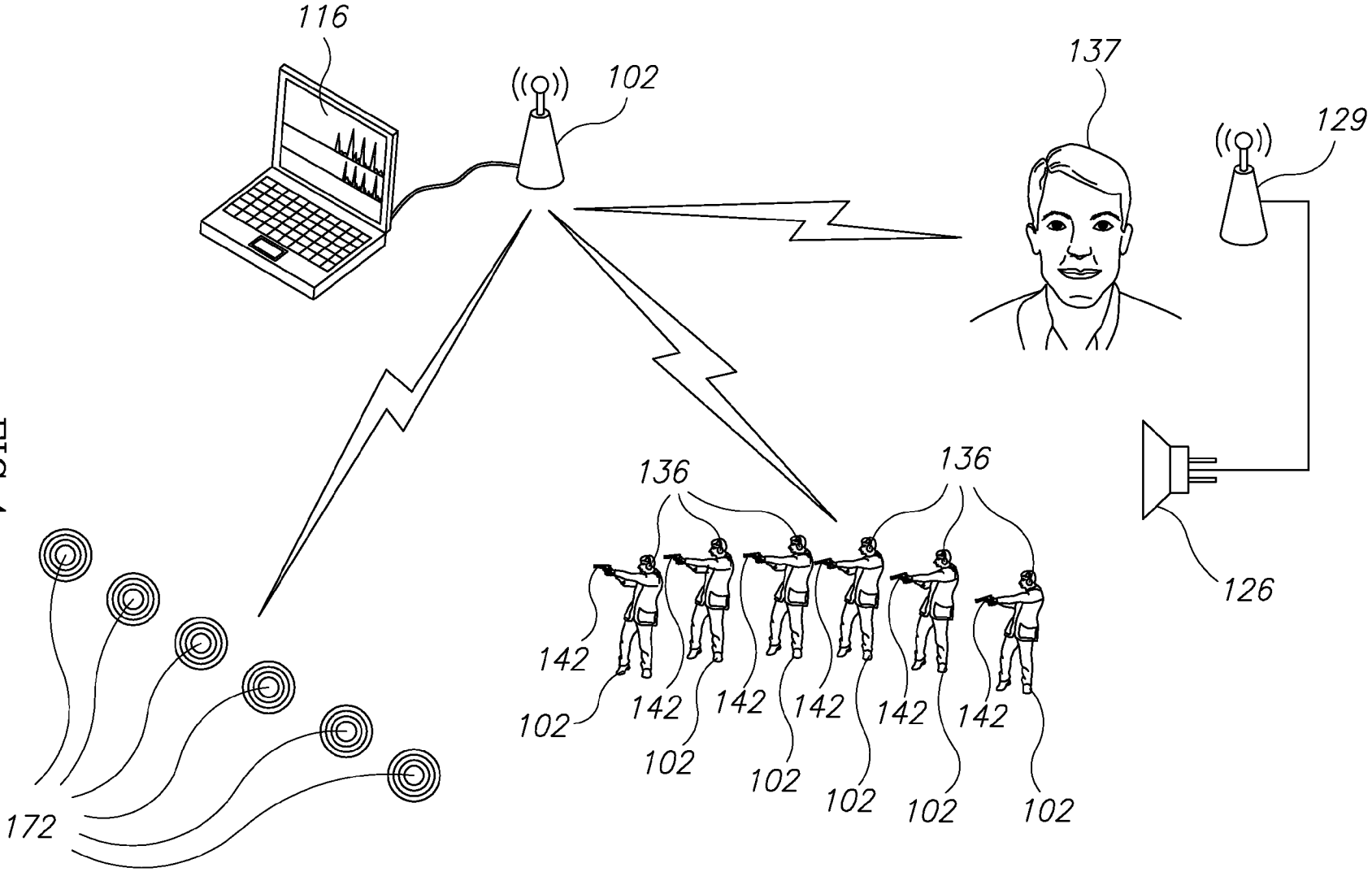
FIG. 4 shows a schematic illustration of a large group embodiment of the shooting range management system shown in FIG. 1, according to some embodiments of the invention.

As seen in FIG. 4, shooting range management system 100 may be utilized for many more than the illustrated multiple shooters 102 and 104; for example six, eight, ten, thirty, fifty or even more shooters.

In embodiments of the inventions, shooting range management system 100 may include a safety module 129 that enables an instructor 137 to shut down one or more system components.

Additionally or alternatively, safety module 129 provides an audio signal through a speaker 126 to indicate, for example, that a ceasefire is in effect. The use of physical signal 126 allows shooters 102 who are wearing or not wearing earphones 136, for example, to be alerted to events.

In alternative embodiments, safety module 129 provides physical signals 126, for example, inter alia, a flag, tape or a sign. In further embodiments, safety module 129 produces automated audio commands that instruct shooters 102 to, for example, start shooting, stop shooting, change position from standing to crouching.

Additionally or alternatively, safety module 129 may include a wireless command system that is transmitted wirelessly to earphones 136 so that the instructor can wirelessly instruct shooters 102 to begin, pause or stop operations.

The inventor has discovered that shooting range management system 100 using a dedicated processing module (not shown) can optionally enable real time monitoring, processing, analyzing and/or viewing of a multi-user training session.

Consistent with some embodiment of the invention, processing module may further be arranged to calculate at least one of: (i) a location of a hit on the target; (ii) a timing of each shot on a specified target; (iii) an association of a series of shots and a specific shooter; (iv) an association of a series of shots and a shooting history of a specific shooter; and (v) recommendations improvement of shooting skills based on the processing and further in view of a series of shots of a specific shooter.

The inventors have additionally discovered that shooting range management system 100 optionally enables post session training or shooting analysis and output, for example, to facilitate group or individual training analysis, feedback and monitoring.

The inventors have further discovered that shooting range management system 100 optionally enables, inter alia, real time or non real time analysis and display of target hitting percentages, accuracy in area of target hit, shooting speed, and time spent on preparation of weapons in preparation for firing.

Figure 5A:
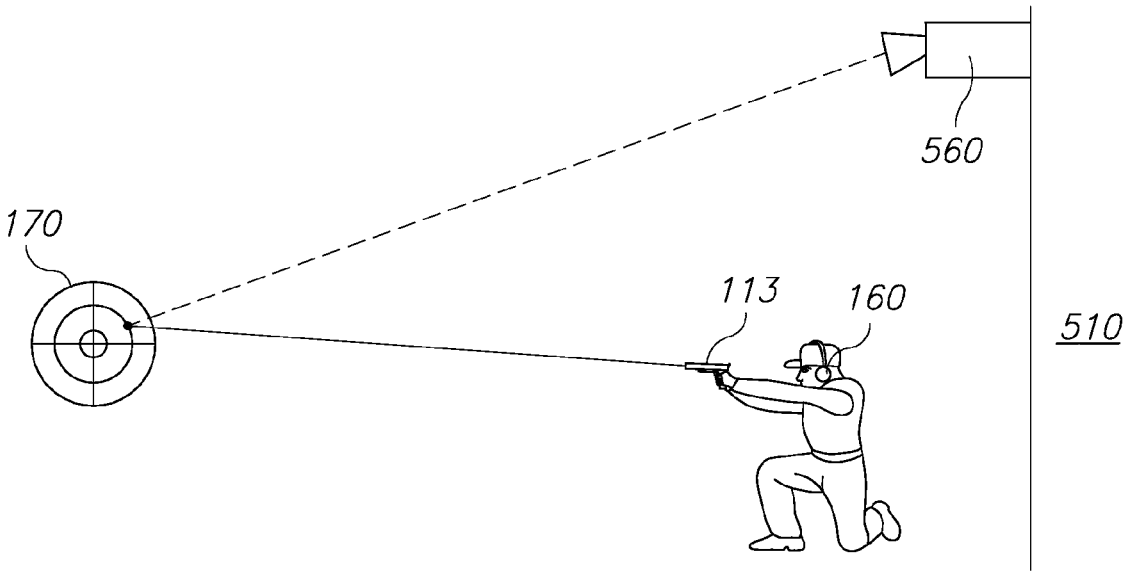
FIG. 5A shows yet another aspect of a shooting range management system, according to some embodiments of the invention.

FIG. 5A shows yet another aspect of a shooting range management system, according to some embodiments of the invention. Shooting management system 510 includes shot recorder 113 associated with a specific shooter 160. In addition to a target 170, there is provided an imaging device (such as a camera) 560 that faces the target. In operation, imaging device captures images (or a video sequence) of target 170. It is understood the imaging device 560 can capture a plurality of target accommodating a plurality of shooters (not shown here). The captured images are used by embodiments of the present invention by processing them and presenting the images in conjunction with data associated with the respective shooter, the timeline and each shooter specific training scheme.

Figure 5B:
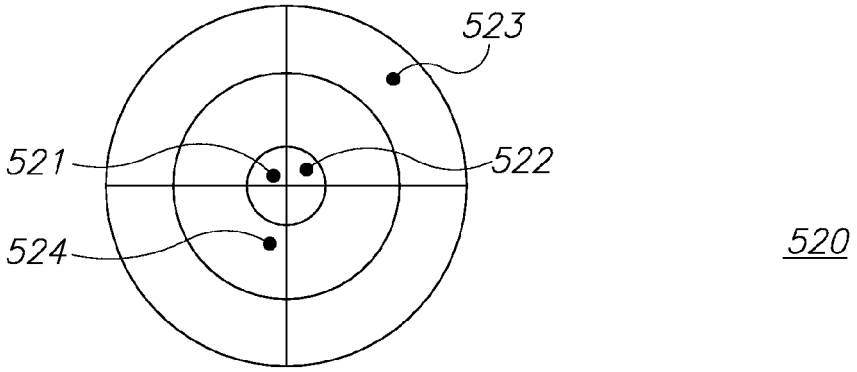
FIG. 5B shows details of a graph related to the shooting range management system shown in FIG. 5A.
Figure 5C:
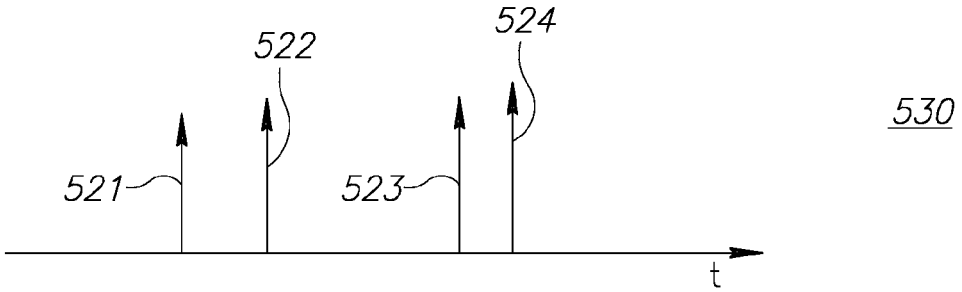
FIG. 5C shows details of yet another graph related to the shooting range management system shown in FIG. 5A.

Consistent with one embodiment, FIG. 5B shows an exemplary presented image of a target 520 showing the hits of a specified shooter indicated by 521-524. Advantageously—the shot recorder and the management system may help determine which hit is associated with which shot along a time line as indicated in FIG. 5C showing a timeline 530 with hits of a specified shooter indicated by 521-524.

Moreover, the target 520 is being recorded by an image device 560. The image is being processed to provide an accurate location of a hit on the target 520. A tracking and location system may identify a location of a shooter in a shooting arena when the shooter is in movement, the shooter is identified by the tracking and location system.

In the above description, an embodiment is an example or implementation of the inventions. The various appearances of "one embodiment", "an embodiment", or "some embodiments", do not necessarily all refer to the same embodiments.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Reference in the specification to "some embodiments", "an embodiment", "one embodiment", or "other embodiments", means that a particular feature, structure, or characteristic described in connection with the embodiments is included in at least some embodiments, but not necessarily all embodiments, of the inventions.

It is to be understood that the phraseology and terminology employed herein are not to be construed as limiting, and are for descriptive purposes only.

The principles and uses of the teachings of the present invention may be better understood with reference to the accompanying description, Figures, and examples.

It is to be understood that the details set forth herein do not construe a limitation to an application of the invention.

Furthermore, it is to be understood that the invention can be carried out or practiced in various ways and that the invention can be implemented in embodiments other than the ones outlined in the description above.

It is to be understood that the terms "including", "comprising", "consisting", and grammatical variants thereof do not preclude the addition of one or more components, features, steps, or integers; or groups thereof, and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques, and procedures by practitioners of the art to which the invention belongs.

The descriptions, examples, methods, and materials presented in the claims and the specification are not to be construed as limiting but rather as illustrative only.

Meanings of technical and scientific terms used herein are to be commonly understood as by one of ordinary skill in the art to which the invention belongs, unless otherwise defined.

The present invention may be implemented in the testing or practice with methods and materials equivalent or similar to those described herein.

Any publications, including patents, patent applications and articles, referenced or mentioned in this specification are herein incorporated in their entirety into the specification, to the same extent as if each individual publication was specifically and individually indicated to be incorporated herein. In addition, citation or identification of any reference in the description of some embodiments of the invention shall not be construed as an admission that such reference is available as prior art to the present invention.

While the invention has been described with respect to a limited number of embodiments, these should not be construed as limitations on the scope of the invention, but rather as exemplifications of some of the preferred embodiments. Other possible variations, modifications, and applications are also within the scope of the invention. Accordingly, the scope of the invention should not be limited by what has thus far been described, but by the appended claims and their legal equivalents.

What is claimed is:

1. A shooting range management system, comprising:

a plurality of shot detection transducers including audio sensors, each worn on a wrist of a respective shooter and identified with the respective shooter, the shot detection transducers configured to detect exit blasts of all shots fired by the respective identified shooters from a plurality of respective ballistic weapons, the detection is of the time of occurrence of the exit blast as a bullet leaves the weapon;

a plurality of impact recorders on a respective plurality of targets, the impact recorders configured to detect impacts of shots on a target;

a receiver configured to wirelessly receive detected exit blasts data and impacts data from the shot detection transducers and the impact recorders, respectively, the receiver including a timer configured to time exit blasts of a plurality of shots by the respective identified shooters from said plurality of weapons in parallel, to time impacts thereof and to produce data records thereof;

a processing module to extract at least data on how many times each of the shooters has shot and missed the target; and a display connected to the receiver, the display configured to display the data records of the receiver.

2. The system according to claim 1, wherein said processing module is further configured to calculate at least one of: (i) a location of a hit on the target; (ii) a timing of each shot on a specified target; (iii) an association of a series of shots and a specific shooter; (iv) an association of a series of shots and a shooting history of a specific shooter; and (v) recommendations for improvement of shooting skills based on the processing and further in view of a series of shots or movements of a specific shooter.

3. A shooting range management system, comprising:

a plurality of shot detection transducers including audio sensors, each worn on a wrist of a respective shooter and identified with the respective shooter, the shot detection transducers configured to detect exit blasts of all shots fired by the respective identified shooters from a plurality of respective ballistic weapons, the detection is of the time of occurrence of the exit blast as a bullet leaves the weapon;

a plurality of impact recorders on a respective plurality of targets, the impact recorders configured to detect impacts of shots on a target;

a receiver configured to wirelessly receive detected exit blasts data and impacts data from the shot detection transducers and the impact recorders, respectively, the receiver including a timer configured to time exit blasts of a plurality of shots by the respective identified shooters from said plurality of weapons in parallel, to time impacts thereof and to produce data records thereof; and a display connected to the receiver, the display configured to display the data records of the receiver, and further including a tracking and location system to identify at least one of: (i) a location of a shooter when the shooter is in movement; (ii) a location of a particular weapon of the plurality of weapons.

4. The system according to claim 3, wherein the shooter is identified by the tracking and location system.

5. A shooting range management system, comprising:

a plurality of shot detection transducers including audio sensors, each worn on a wrist of a respective shooter and identified with the respective shooter, the shot detection transducers configured to detect exit blasts of all shots fired by the respective identified shooters from a plurality of respective ballistic weapons, the detection is of the time of occurrence of the exit blast as a bullet leaves the weapon;

a plurality of impact recorders on a respective plurality of targets, the impact recorders configured to detect impacts of shots on a target;

a receiver configured to wirelessly receive detected exit blasts data and impacts data from the shot detection transducers and the impact recorders, respectively, the receiver including a timer configured to time exit blasts of a plurality of shots by the respective identified shooters from said plurality of weapons in parallel, to time impacts thereof and to produce data records thereof;

a processing module to extract at least data on how many times each of the shooters has shot and missed the target; and a display connected to the receiver, the display configured to display the data record of the receiver, wherein the system is connected via a connection link to a website.

6. The system according to claim 5, wherein the website includes training programs, firing tests, social and professional network.

7. The system according to claim 1, wherein at least one impact detector comprises at least one of: a vibration sensor, a shock sensor, a motion sensor, a sound sensor, a pressure sensor, and an imaging device.

8. The system according to claim 1, wherein the shot detection transducer is further configured to detect movements of the weapon and a shooter holding the weapon, wherein said movements are made without firing and wherein the system further comprises a processing module configured to assign over a timeline both exit blasts and said movements.

* * * * *